US008016731B2

(12) United States Patent
Vanterpool

(10) Patent No.: US 8,016,731 B2
(45) Date of Patent: Sep. 13, 2011

(54) ABDOMINAL EXERCISE MACHINE

(76) Inventor: Rael Vanterpool, Miami, FL (US)

( * ) Notice: Subject to any disclaimer, the term of this patent is extended or adjusted under 35 U.S.C. 154(b) by 0 days.

(21) Appl. No.: 12/652,106

(22) Filed: Jan. 5, 2010

(65) Prior Publication Data

US 2010/0204025 A1 Aug. 12, 2010

Related U.S. Application Data

(60) Provisional application No. 61/142,696, filed on Jan. 6, 2009.

(51) Int. Cl.
*A63B 21/00* (2006.01)

(52) U.S. Cl. ..... 482/133

(58) Field of Classification Search ..... 482/142, 482/140, 121–133, 148, 51, 139, 92
See application file for complete search history.

(56) References Cited

U.S. PATENT DOCUMENTS

| | | | | |
|---|---|---|---|---|
| 3,000,632 | A * | 9/1961 | Fuchs | 482/97 |
| 4,802,462 | A * | 2/1989 | Reiss et al. | 601/35 |
| 5,090,695 | A | 2/1992 | Ciolino | |
| 5,624,361 | A | 4/1997 | Lai | |
| 5,665,041 | A | 9/1997 | Hsieh | |
| 5,752,879 | A | 5/1998 | Berdut | |
| 5,752,902 | A | 5/1998 | Walker | |
| 5,833,590 | A | 11/1998 | Chiu et al. | |
| 5,902,220 | A | 5/1999 | Lin | |
| 6,206,809 | B1 | 3/2001 | Habing | |
| 6,755,771 | B2 | 6/2004 | Wallerstein | |
| 6,855,098 | B2 * | 2/2005 | Reitz et al. | 482/142 |
| 6,939,272 | B1 * | 9/2005 | Wu | 482/92 |
| 6,966,872 | B2 * | 11/2005 | Eschenbach | 482/142 |
| 7,125,372 | B1 | 10/2006 | Teeter et al. | |
| 2004/0092372 | A1 | 5/2004 | Clark, III | |
| 2007/0066463 | A1 | 3/2007 | Araujo | |

FOREIGN PATENT DOCUMENTS

| | | |
|---|---|---|
| SU | 1678397 A | 9/1991 |
| WO | WO 9727904 | 8/1997 |
| WO | WO 9843707 | 10/1998 |

* cited by examiner

*Primary Examiner* — Lori Baker
(74) *Attorney, Agent, or Firm* — Feldman Gale, P.A.; Michael C. Cesarano; Richard Guerra

(57) ABSTRACT

A sports fitness/rehabilitation machine assists in strengthening the abdominal muscle region and includes a base having a main adjustment assembly, an upper adjustable support pivotally attached to the main adjustment assembly, and a lower adjustable support pivotally attached to said main adjustment assembly. The machine may also include an upper adjustable support arm, handle bars, a back and headrest pad, a leg adjustment member, and a foot rest, or any combination of these additional features.

14 Claims, 5 Drawing Sheets

ABDOMINAL EXERCISE MACHINE

CROSS REFERENCE TO RELATED APPLICATIONS

This application claims benefit of U.S. Application No. 61/142,696 filed Jan. 6, 2009, the disclosure of which is incorporated herein in its entirety.

FIELD OF THE INVENTION

This invention is in the field of exercise apparatus that promotes the development of muscular strength, flexibility, and agility through means of mechanical movement and leverage that is provided by machinery constructed for the specific purpose.

BACKGROUND OF THE INVENTION

Mechanical apparatus for developing strength, flexibility, and agility have been known and used from antiquity to the present. In the past 50 years, machines have been created that may be configured to provide specific resistance and tailored movement for many individuals having different muscle strengths, range of movement, and exercise goals. By being configurable for a variety of possible users, a single machine may replace or be substituted for a range of potential exercises that formerly were done on a number of single-use machines. The first of such machines were normally dedicated to improving arm strength or leg strength. Exercises involving the stomach or abdominal muscles were generally carried out by lying on a mat on a floor, and using the body's own resistance to work abdominal muscles. Such exercise, however, was limited in the range of movement and muscle groups that could be worked. Accordingly, there is a need for apparatus that permits the exercise of stomach or abdominal muscles over a range of movement and motion, and that permits the user to work all muscle groups within that part of the body.

SUMMARY OF THE INVENTION

The present invention is comprised of a sports fitness/rehabilitation machine that assists in strengthening the abdominal muscle region as well as core stabilizers of the groin and lower back. The present invention can be adjusted so that the user can be positioned in multiple angles, thus increasing or decreasing the level of intensity asserted by the abdominal muscles as the user engages the machine.

The present invention is comprised of an upper adjustable support and a lower adjustable support that are each pivotally attached to a foundation frame. The upper adjustable support and lower adjustable support can each be adjusted to various fixed positions within a range of degrees on an arc. The upper adjustable support can be fixed to a position without effecting the position of the lower adjustable support. Likewise, the lower adjustable support can be fixed to a position without effecting the position of the upper adjustable support. The lower adjustable support can be further comprised of an adjustable footrest capable of accommodating different heights and lengths of the user.

Because the upper adjustable support and lower adjustable support can be independently fixed at various degrees along an arc, the present invention allows the user to independently train the upper and lower abdominal muscle regions. The present invention thus allows a user to safely and effectively position the body to execute a range of abdominal exercises.

DETAILED DESCRIPTION OF THE PREFERRED EMBODIMENTS

Figure 1:
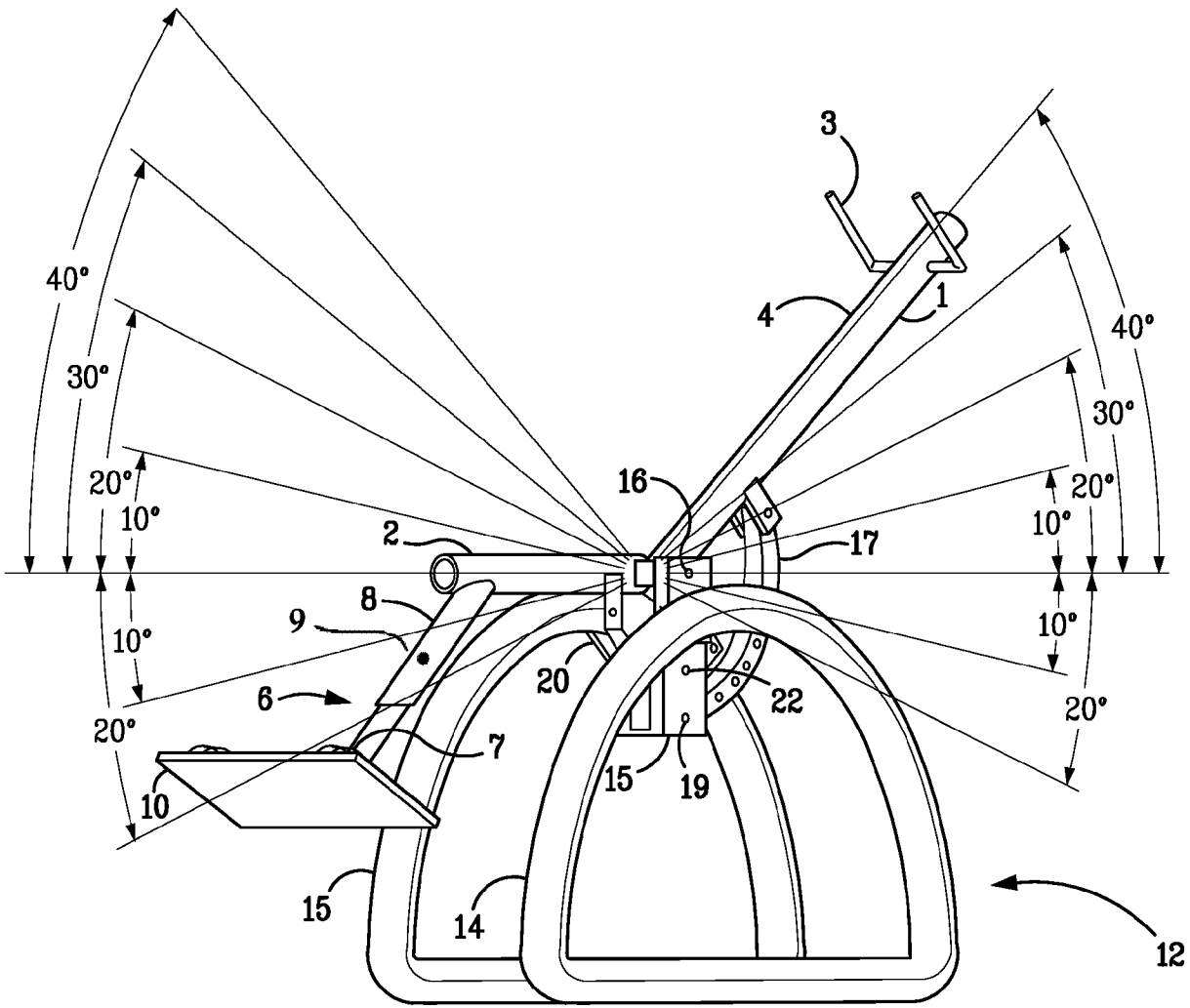
FIG. 1 is a side view of the exercise machine.
Figure 2:
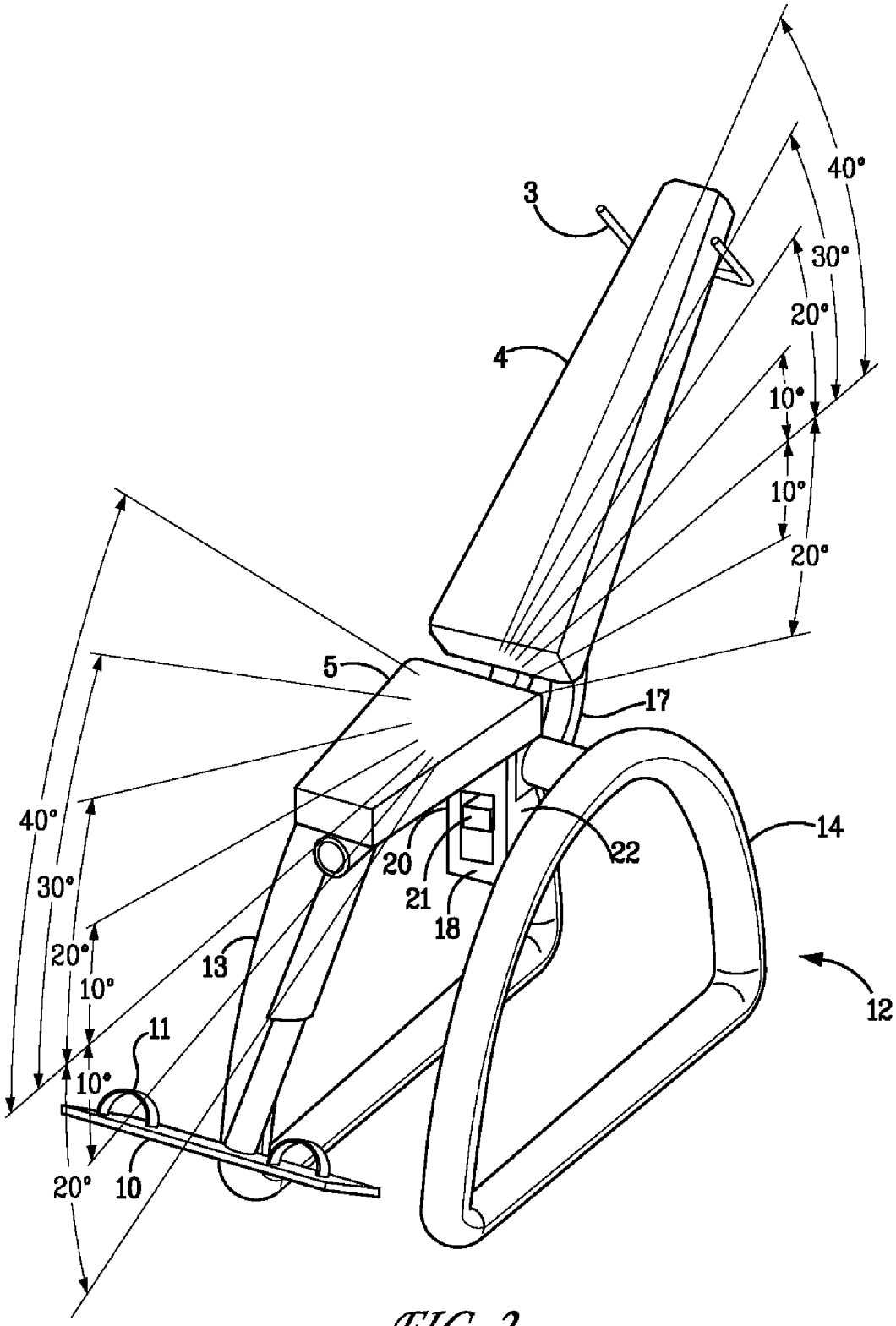
FIG. 2 is a perspective view of the exercise machine.

With reference to FIGS. 1 and 2, the present invention is comprised of an upper adjustable support 1 to support the user's upper body, and a lower adjustable support 2 to support the user's lower body. In another embodiment of the present invention, handle bars 3 are affixed to opposing sides of upper adjustable support 1, preferably near the region of upper adjustable support 1 most distal to lower adjustable support 2. Handle bars 3 are preferably shaped so that the user can grasp the handle bars while engaging the machine. Upper adjustment support 1 can further comprise a back and headrest pad 4 made of any acceptable material known and used by those of ordinary skill in the art.

As further illustrated by FIGS. 1 and 2, lower adjustable support 2 is further comprised of seating pad 5 made of any acceptable material known and used by those of ordinary skill in the art. Preferably, lower adjustable support 2 is further comprised of leg adjustment member 6. In one embodiment of the present invention, leg adjustment member 6 is comprised of a receiving member 7 and an insertion member 8. Insertion member 8 can be further comprised of a retractable pin 9 that can be inserted into any one of a plurality of corresponding holes located on receiving member 7. By adjusting the position of retractable pin 9 along any one of the plurality of holes located on receiving member 7, the length of leg adjustment member 6 can be varied in accordance with the length and height of the user. In yet another embodiment of the present invention, leg adjustment member 6 is further comprised of footrest 10 having feet straps 11 for securing the user's feet while the user engages the machine.

As illustrated by FIGS. 1 through 5, the present invention is further comprised of a base 12 that attaches to and supports upper adjustable support 1 and lower adjustable support 2. In one embodiment of the present invention, base 12 is comprised of arched legs 13 and 14. Arched legs 13 and 14 are spaced parallel to each other and provide enough distance between one another to allow both upper adjustable support 1 and lower adjustable support 2 to be positioned in between arched legs 13 and 14.

In yet another embodiment of the present invention, base 12 is further comprised of a main adjustment assembly 15 located between and attached to arched legs 13 and 14. Preferably, both upper adjustable support 1 and lower adjustable support 2 pivotally attach to main adjustment assembly 15 at central axis pin 16. Pivotal attachment to central axis pin 16 allows both upper adjustable support 1 and lower adjustable support 2 to rotate circumferentially along an arc relative to central axis pin 16.

Figure 3:
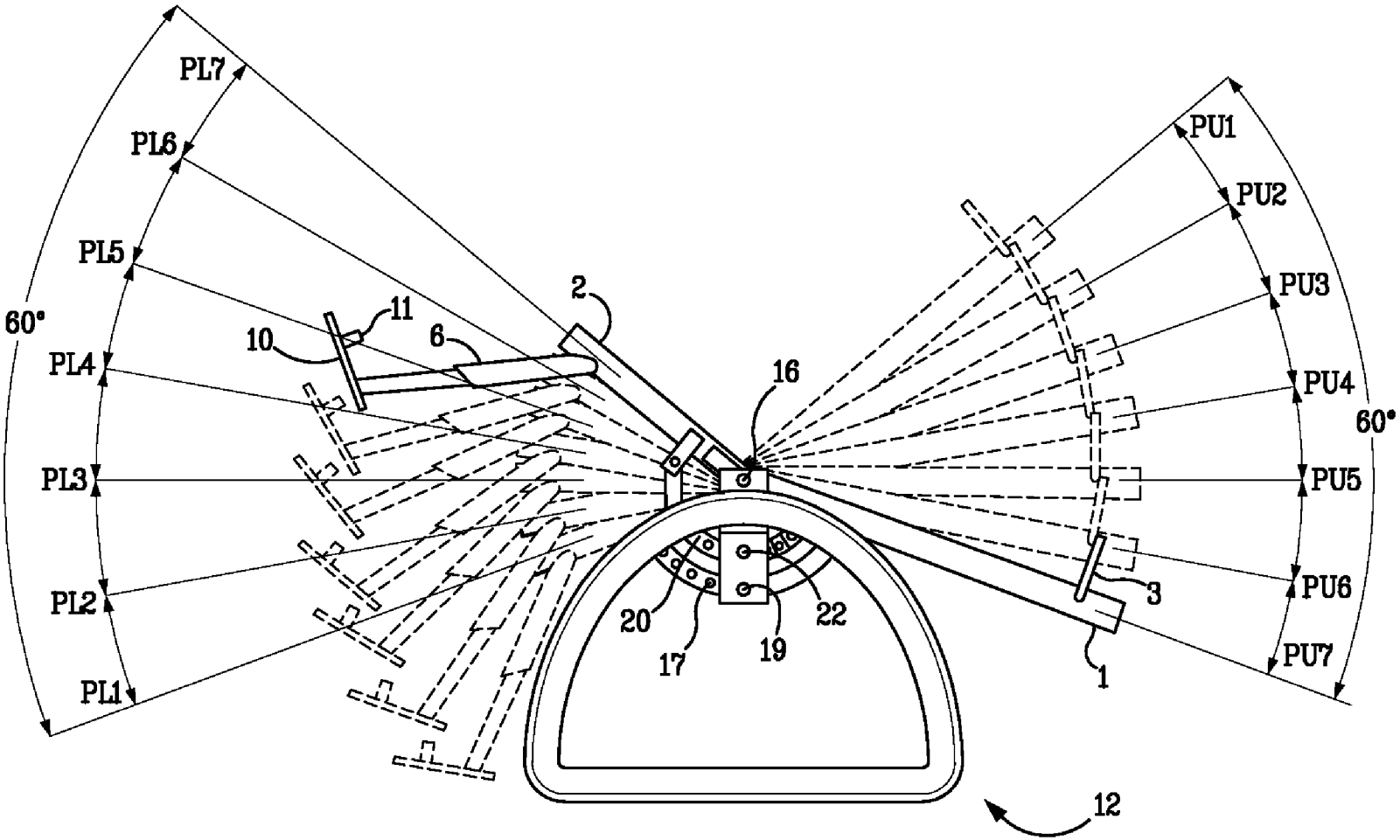
FIG. 3 is a side view of the exercise machine further demonstrating the range of positions within which the upper adjustable support and the lower adjustable support can be fixed.
Figure 5:
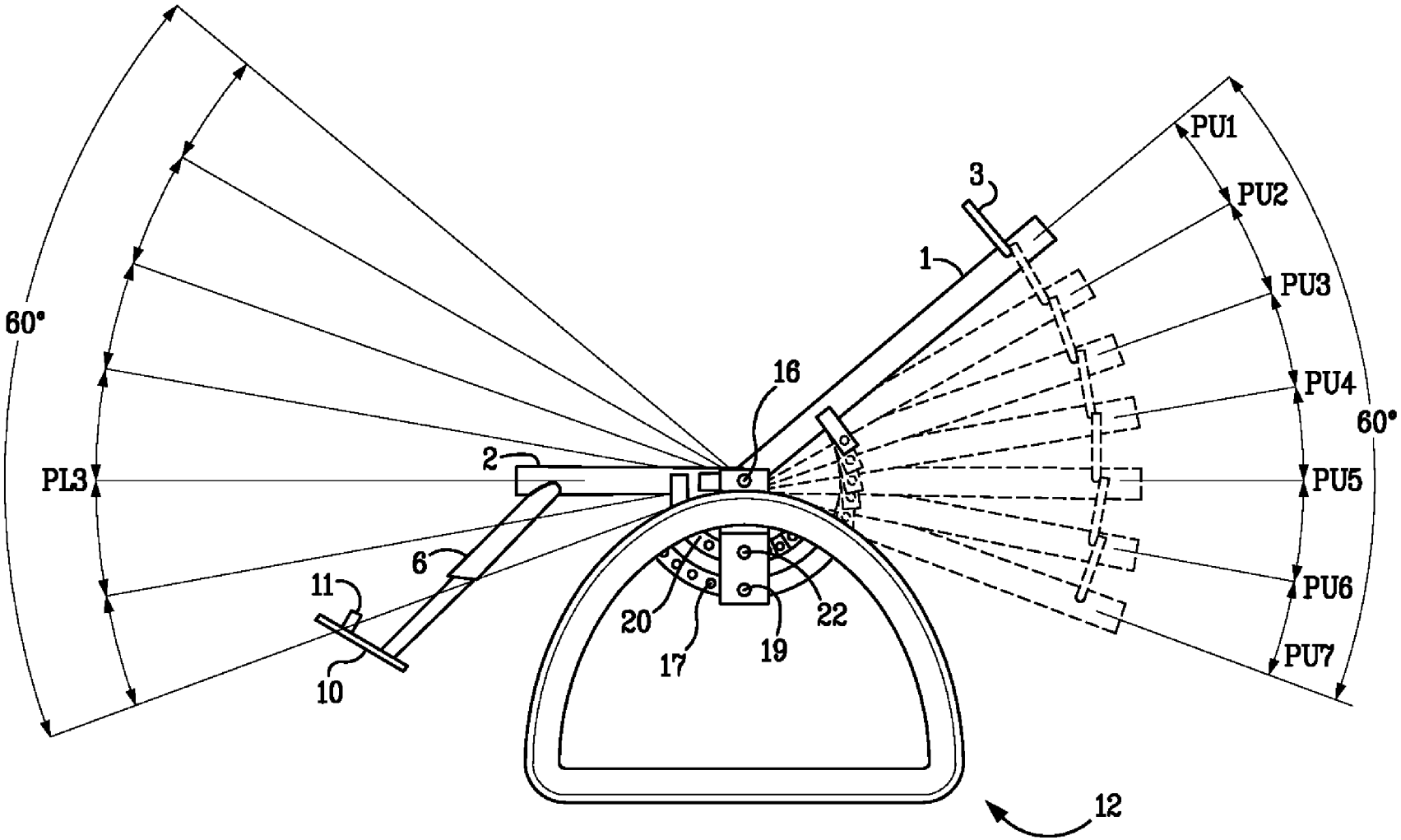
FIG. 5 is a side view of the exercise machine further demonstrating the range of positions within which the upper adjustable support can be fixed without effecting the position of the lower adjustable support.

In this embodiment, upper adjustable support 1 is further comprised of an upper adjustment arm 17. Upper adjustment arm 17 is preferably arc-shaped. A first end of upper adjustment arm 17 is fixed to upper adjustable support 1, near the region most proximal to lower adjustable support 2. A second end of upper adjustment arm 17 remains unattached and is capable of sliding into and out of an upper adjustment chamber 18 located in main adjustment assembly 15. An upper adjustment pin 19 located in upper adjustment chamber 18 engages any one of a plurality of holes located on upper adjustment arm 17. As depicted in FIGS. 3 and 5, as the second end of upper adjustment arm 17 ingresses into or egresses out of upper adjustment chamber 18, the user can engage and secure upper adjustment pin 19 into any one of the plurality of holes located on upper adjustment arm 17, thereby fixing the position of upper adjustable support 1 to a desired angle relative to central axis pin 16.

Figure 4:
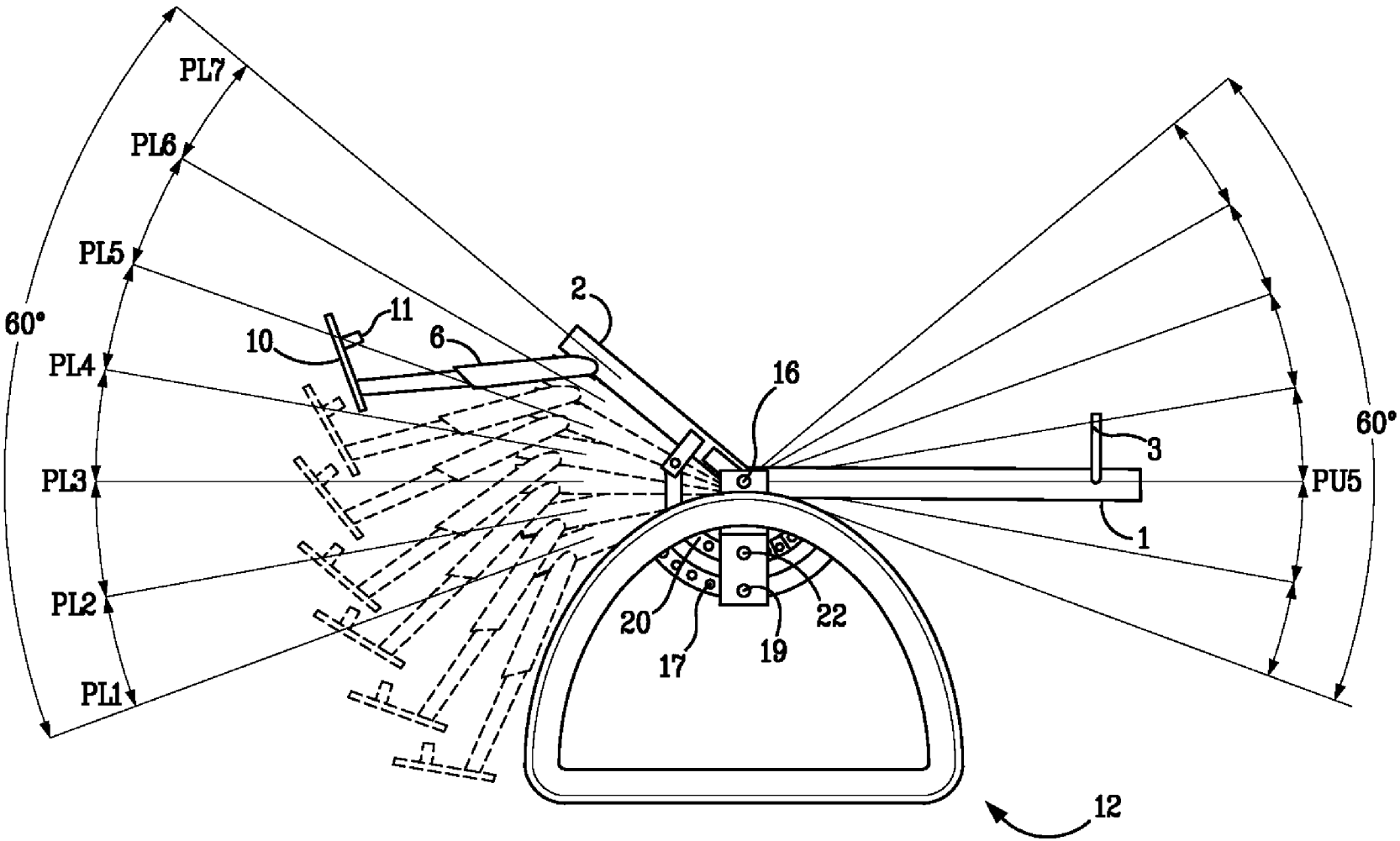
FIG. 4 is a side view of the exercise machine further demonstrating the range of positions within which the lower adjustable support can be fixed without effecting the position of the upper adjustable support.

In this embodiment, lower adjustable support 2 is further comprised of a lower adjustment arm 20. Lower adjustment arm 20 is preferably arc-shaped. A first end of lower adjustment arm 20 is fixed to lower adjustable support 2, near the region most proximal to upper adjustable support 1. A second end of lower adjustment arm 20 remains unattached and is capable of sliding into and out of a lower adjustment chamber 21 located in main adjustment assembly 15. A lower adjustment pin 22 located in lower adjustment chamber 21 engages any one of a plurality of holes located on lower adjustment arm 20. As depicted in FIGS. 3 and 4, as the second end of lower adjustment arm 20 ingresses into or egresses out of lower adjustment chamber 21, the user can engage and secure lower adjustment pin 22 into any one of the plurality of holes located on lower adjustment arm 20, thereby fixing the position of lower adjustable support 2 to a desired angle relative to central axis pin 16.

As illustrated by FIGS. 3 through 5, in an even more preferred embodiment of the present invention, upper adjustable support 1 can be fixed at seven different positions (PU1, PU2, PU3, PU4, PUS, PU6, and PU7) located along a 60 degree arc relative to central axis pin 16, and lower adjustable support 2 can be fixed at seven different positions (PL1, PL2, PL3, PL4, PL5, PL6, and PL7) located along a 60 degree arc relative to central axis pin 16. As further illustrated by FIG. 4, lower adjustable support 2 can be fixed to any one of positions PL1 through PL7 without effecting the position of upper adjustable support 1. As further illustrated by FIG. 5, upper adjustable support 1 can be fixed to any one of positions PU1 through PU7 without effecting the position of lower adjustable support 2.

In another embodiment of the present invention, upper adjustable support 1 and lower adjustable support 2 are detachable from base 12, thereby facilitating storage and portability of the apparatus.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed:

1. A sports fitness/rehabilitation machine that assists in strengthening the abdominal muscle region comprising:

a base having a main adjustment assembly;

an upper support pivotally attached to said main adjustment assembly;

a lower support pivotally attached to said main adjustment assembly;

said upper support being adjustable within said main adjustment assembly whereby said upper support can be moved to one of a plurality of fixed positions within a range of degrees on an arc and fixedly secured at one of said plurality of fixed positions independently of the movement or position of said lower support;

said lower support being adjustable within said main adjustment assembly whereby said lower support can be moved to one of a plurality of fixed positions within a range of degrees on an arc and fixedly secured at one of said plurality of fixed positions independently of the movement or position of said upper support;

said upper support further comprising an upper support arm having a first end fixed to said upper support and an unattached second end whereby said second end is capable of sliding into and out of said main adjustment assembly.

2. A sports fitness/rehabilitation machine that assists in strengthening the abdominal muscle region comprising:

a base having a main adjustment assembly;

an upper support pivotally attached to said main adjustment assembly;

a lower support pivotally attached to said main adjustment assembly;

said upper support being adjustable within said main adjustment assembly whereby said upper support can be moved to one of a plurality of fixed positions within a range of degrees on an arc and fixedly secured at one of said plurality of fixed positions independently of the movement or position of said lower support;

said lower support being adjustable within said main adjustment assembly whereby said lower support can be moved to one of a plurality of fixed positions within a range of degrees on an arc and fixedly secured at one of said plurality of fixed positions independently of the movement or position of said upper support;

said lower support further comprising a lower support arm having a first end fixed to said lower support and an unattached second end whereby said second end is capable of sliding into and out of said main adjustment assembly.

3. The machine of claim 1 wherein said upper support further comprises handle bars.

4. The machine of claim 1 wherein said upper support further comprises a back and headrest pad.

5. The machine of claim 1 wherein said lower support further comprises a leg adjustment member.

6. The machine of claim 5 wherein said leg adjustment member further comprises a foot rest.

7. The machine of claim 6 wherein said foot rest further comprises foot straps.

8. The machine of claim 1 wherein said lower support further comprises a seat pad.

9. The machine of claim 2 wherein said upper support further comprises handle bars.

10. The machine of claim 2 wherein said upper support further comprises a back and headrest pad.

11. The machine of claim 2 wherein said lower support further comprises a leg adjustment member.

12. The machine of claim 11 wherein said leg adjustment member further comprises a foot rest.

13. The machine of claim 12 wherein said foot rest further comprises foot straps.

14. The machine of claim 2 wherein said lower support further comprises a seat pad.

* * * * *